US008608396B2

(12) United States Patent
Bober et al.

(10) Patent No.: US 8,608,396 B2
(45) **Date of Patent: *Dec. 17, 2013**

(54) FLOOR FINISH APPLICATOR

(71) Applicant: Diversey, Inc., Sturtevant, WI (US)

(72) Inventors: Andrew M. Bober, Racine, WI (US); Charles A. Crawford, Racine, WI (US); Lance D. Brown, Racine, WI (US); Douglas S. Rodenkirch, Sun Prairie, WI (US); Scott I. Biba, Highland, WI (US); Craig P. Conner, Madison, WI (US); Daniel R. Nett, Sun Prairie, WI (US); Nicholas S. Reback, Monona, WI (US)

(73) Assignee: Diversey, Inc., Sturtevant, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/759,595

(22) Filed: Feb. 5, 2013

(65) Prior Publication Data

US 2013/0149020 A1 Jun. 13, 2013

Related U.S. Application Data

(63) Continuation of application No. 13/157,582, filed on Jun. 10, 2011, now Pat. No. 8,366,336, which is a continuation of application No. 11/780,733, filed on Jul. 20, 2007, now abandoned, which is a continuation-in-part of application No. 11/744,967, filed on May 7, 2007, now Pat. No. 7,850,383.

(51) Int. Cl.

| | |
|---|---|
| ***A46B 11/00*** | (2006.01) |
| ***F04B 17/06*** | (2006.01) |
| ***F04B 35/00*** | (2006.01) |

(52) U.S. Cl.
USPC ..... 401/48; 401/139; 401/268; 401/292; 417/231; 417/233; 417/319

(58) Field of Classification Search
USPC ..... 417/231, 233, 319; 401/48, 137, 139, 401/268, 292; 239/146, 155, 157, 99, 100; 118/207, 264, 266, 305; 15/98
See application file for complete search history.

(56) References Cited

U.S. PATENT DOCUMENTS 1,516,734 A * 11/1924 Johnson ..... 74/810.1
1,786,067 A * 12/1930 Horste ..... 74/15.6

(Continued)

FOREIGN PATENT DOCUMENTS

JP 63071101 3/1988
JP 4-106673 9/1992

(Continued)

*Primary Examiner* — Charles Freay
(74) *Attorney, Agent, or Firm* — Michael Best & Friedrich, LLP

(57) ABSTRACT

A floor finish applicator including a cart having wheels and a body member constructed and arranged to receive a source of floor finish. The floor finish applicator also includes a pump coupled to the cart and operable to deliver floor finish to a floor, a floor finish feed conduit in fluid communication between the pump and a container supporting floor finish, and a transmission assembly coupled to the cart. The floor finish feed conduit supplies floor finish to the pump. The transmission assembly includes an axle coupled to and driven by a wheel of the cart, a drive gear connected to the axle, a drive shaft having a driven gear for engaging the drive gear and driving the pump, and a hand-actuated spring-loaded clutch for selective engagement of the pump and the drive shaft with the axle.

20 Claims, 11 Drawing Sheets

(56) References Cited

U.S. PATENT DOCUMENTS

| | | | | |
|---|---|---|---|---|
| 2,737,340 | A * | 3/1956 | Bonini | 417/362 |
| 3,174,604 | A * | 3/1965 | Lambie | 192/99 S |
| 6,378,162 | B1 | 4/2002 | Zahuranec et al. | |
| 6,875,497 | B2 | 4/2005 | Emery et al. | |
| 7,850,383 | B2 * | 12/2010 | Bober et al. | 401/137 |
| 8,366,336 | B2 * | 2/2013 | Bober et al. | 401/48 |
| 2008/0104783 | A1 | 5/2008 | Crawford et al. | |

FOREIGN PATENT DOCUMENTS

| | | |
|---|---|---|
| JP | 0570451 | 9/1993 |
| JP | 11155789 | 6/1999 |
| JP | 11267080 | 10/1999 |
| JP | 2006212279 | 8/2006 |

* cited by examiner

FLOOR FINISH APPLICATOR

CROSS-REFERENCE TO RELATED APPLICATIONS

This is a continuation of U.S. Ser. No. 13/157,582, filed Jun. 10, 2011, now U.S. Pat. No. 8,366,336, which is a continuation of U.S. Ser. No. 11/780,733, filed Jul. 20, 2007, now abandoned, which is a continuation-in-part of U.S. Ser. No. 11/744,967, filed May 7, 2007, now U.S. Pat. No. 7,850,383, the contents of which are hereby incorporated by reference.

FIELD OF THE INVENTION

The present invention relates to applicators for floor finish. More particularly, it relates to a simplified pull-behind floor finish applicator which utilizes a pump and a detachable mop as a component of a pull-behind cart.

BACKGROUND OF THE INVENTION

Pull-behind floor finish applicators are disclosed in U.S. Pat. No. 2,979,756; No. 3,457,015; No. 3,981,596; No. 4,124,315; and No. 4,471,713. Other floor finish applicators of this type are available from Fast-Trak Inc. as Ultra-Trak floor finish applicator and Hillyard, Inc. of St. Joseph, Mo. as Multi-Flo applicator.

These applicators involve mechanisms which have numerous components and/or do not provide for a separate mopping function. For example, the applicators described in U.S. Pat. No. 2,979,756 and No. 3,981,596 include pressurized tanks with complex delivery systems. These involve time consuming cleaning operations. Those described in U.S. Pat. No. 3,457,015 and No. 4,124,315 do not provide for a separate mopping function.

A pull-behind floor finish applicator should be simple in its construction so as to be economical to produce. It should also be capable of applying floor finish in those places where the application cannot readily be achieved.

The prior art does not provide a floor finish applicator which has a minimum number of parts, yet can apply floor finish in floor areas which are both readily accessible by a mobile machine and those which are not.

SUMMARY OF THE INVENTION

One embodiment of the present invention provides a pull-behind floor finish applicator which includes a wheeled cart and receives a source of floor finish. A floor finish spreading mop having a handle member and a floor finish spreading member is detachably mounted on the cart. In one embodiment, the floor finish spreading mop is detachably mounted to the cart by a clamp member. There is at least one conduit connected to the source of floor finish to deliver floor finish to a floor. In some embodiments, a valve member is operatively associated with the conduit, and a valve actuating member is operatively connected to the valve member. In some embodiments, the valve member is a pinch valve.

In some embodiments there is a skid member connected to the cart, the mop positioned on the cart in a manner to position the cart at about 5 degrees from an upright position toward the front side of the cart.

In some embodiments, there is a carrier member connected to the cart and a bag in the box containing a floor finish positioned in the carrier member. In some embodiments, the floor finish is delivered to the flow via gravity feed. In other embodiments, the floor finish is delivered via the assistance of a pump assembly. In some embodiments, the pump is a peristaltic pump.

In some embodiments, the pump assembly is driven by a power delivered via rotation of the wheel on the cart.

Some embodiments of the invention are directed toward a transmission assembly for selectively driving a pump on a floor finish applicator cart having wheels. The transmission assembly comprises an axle coupled to and driven by a wheel on the cart, a drive gear connected to the axle; and a drive shaft with a bevel gear for engaging the drive gear and driving the pump. In some embodiments, the drive gear includes a one-way roller clutch. In some embodiments, the transmission assembly also includes a spring loaded clutch actuator, wherein the spring loaded clutch actuator includes at least one thrust washer and a pivotal bar member for engaging the thrust washer.

Some embodiments are also directed toward a floor finish applicator having a body member adapted to support a reservoir of floor finish, a handle coupled to the body, a pair of wheels coupled to the body member and at least partially defining a pivot point of the body when force is applied to the handle, and a kick-stand pivotally coupled to the body and engagable with the floor to support the body in a raised position relative to the floor, wherein the kick-stand is biased about a pivot point toward the body when not engaged with the floor.

DESCRIPTION OF THE ILLUSTRATED EMBODIMENTS

Figure 1:
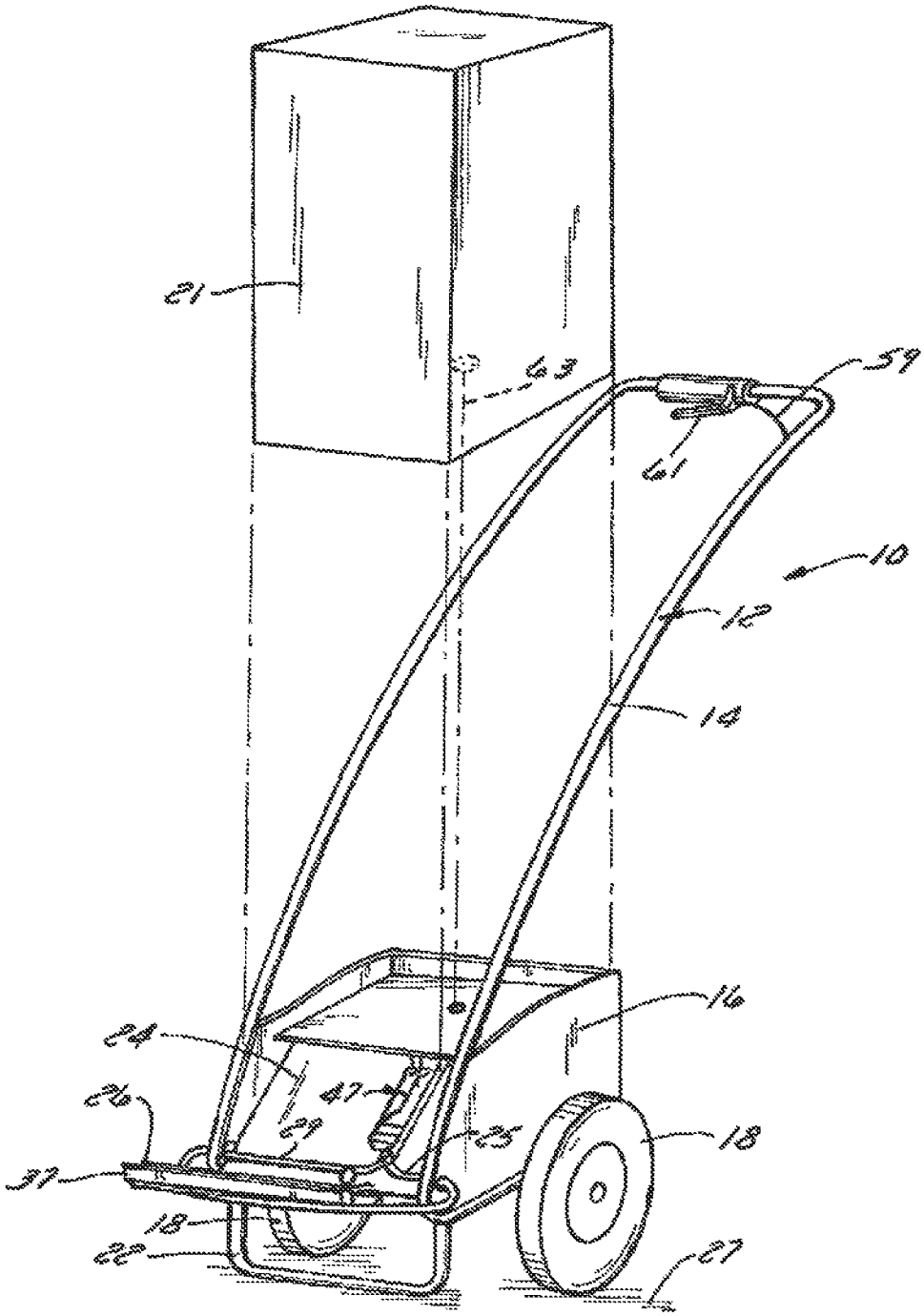
FIG. 1 is a perspective view of the floor finish applicator illustrating the placement of a box containing floor finish thereon.
Figure 2:
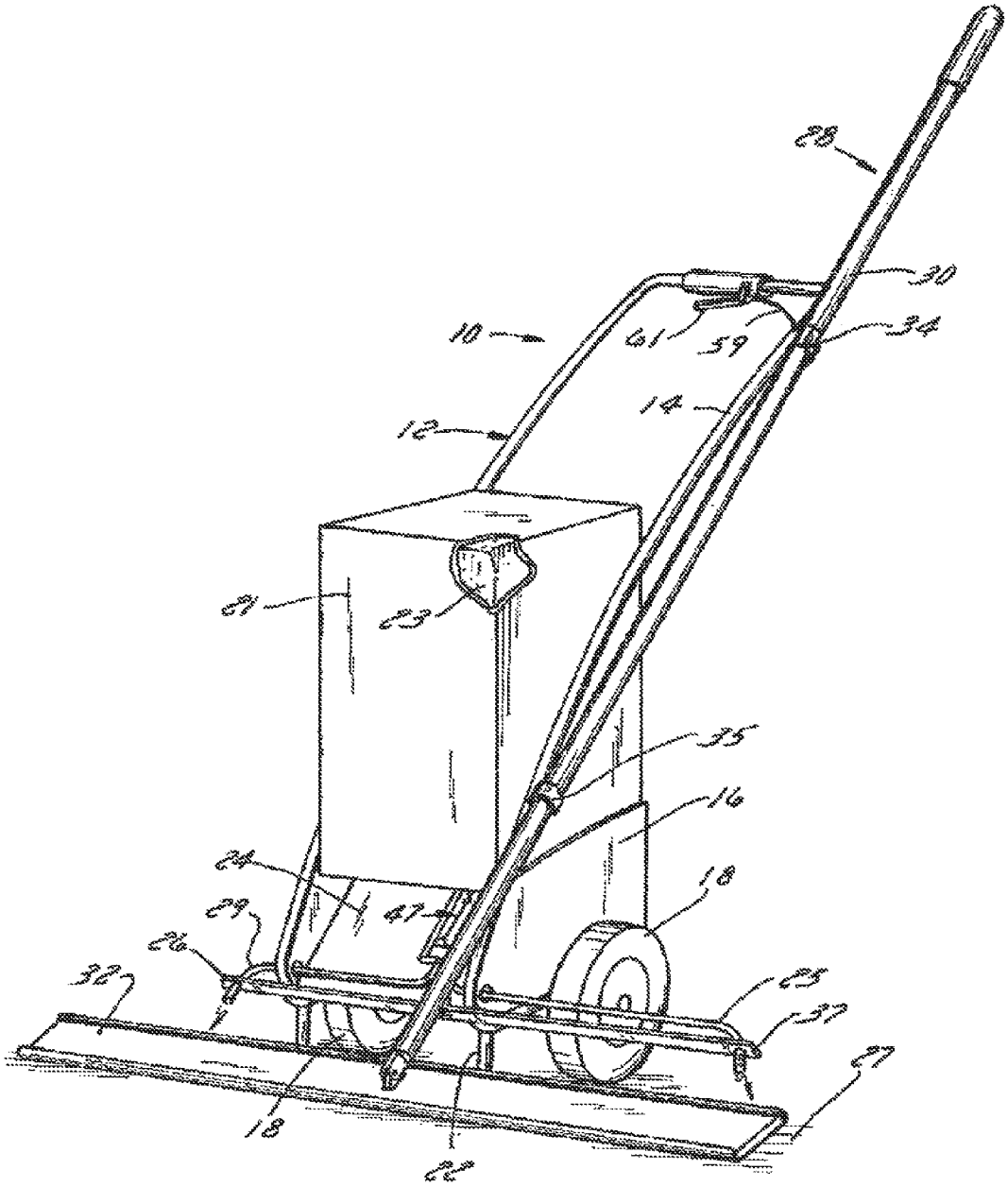
FIG. 2 is a view similar to FIG. 1 showing the attachment of a mop.
Figure 3:
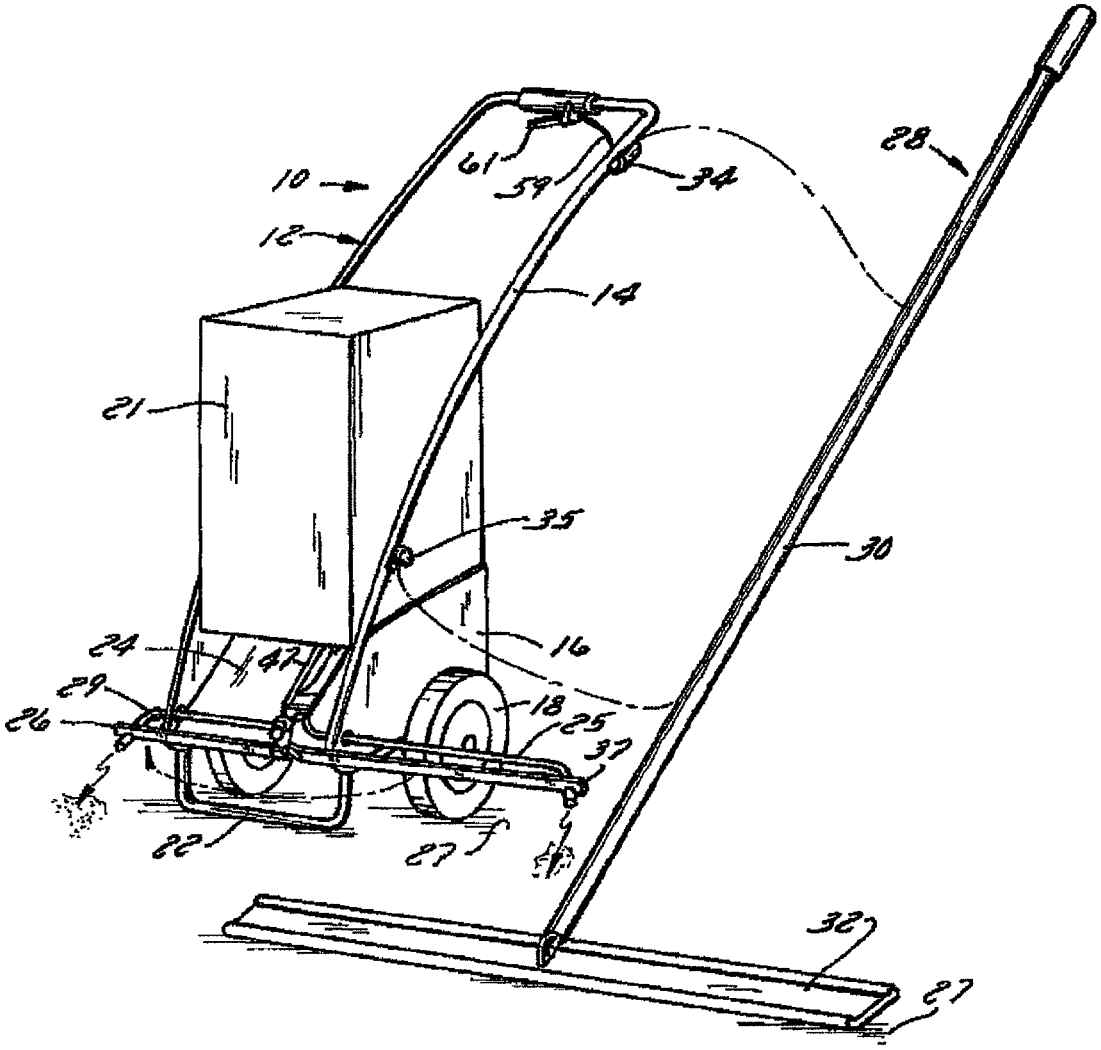
FIG. 3 is a view similar to FIG. 2 showing the mop disconnected from the applicator.

Referring to FIGS. 1-3, the floor finish applicator 10 generally includes a cart 12 with a U-shaped tubular handle member 14 joined to a base portion 16 with wheels 18 rotatably mounted thereon. A box 21 with a bag 23 containing floor finish is supported on base portion 16 which provides a carrier member for the box 21. A sloping panel 24 encloses the base portion 16. Cart 12 is supported by skid member 22. Also connected to the handle member 14 is a spreader bar member 26 with a second spreader bar member 37 connected thereto. Spreader bar members 26 and 37 support floor finish conveying, flexible conduits 25 and 29 for depositing floor finish on floor surface 27. A mop generally 28 having a handle 30 and pad 32 is removably attached to the handle member 14 by the clamps 34 and 35. In a preferred manner, mop pad 32 is comprised of materials of different sizes for purpose of spreading and leveling the floor finish. It can be made of foam, flocked foam, woven or non-woven cloth.

Figures 5, 6:
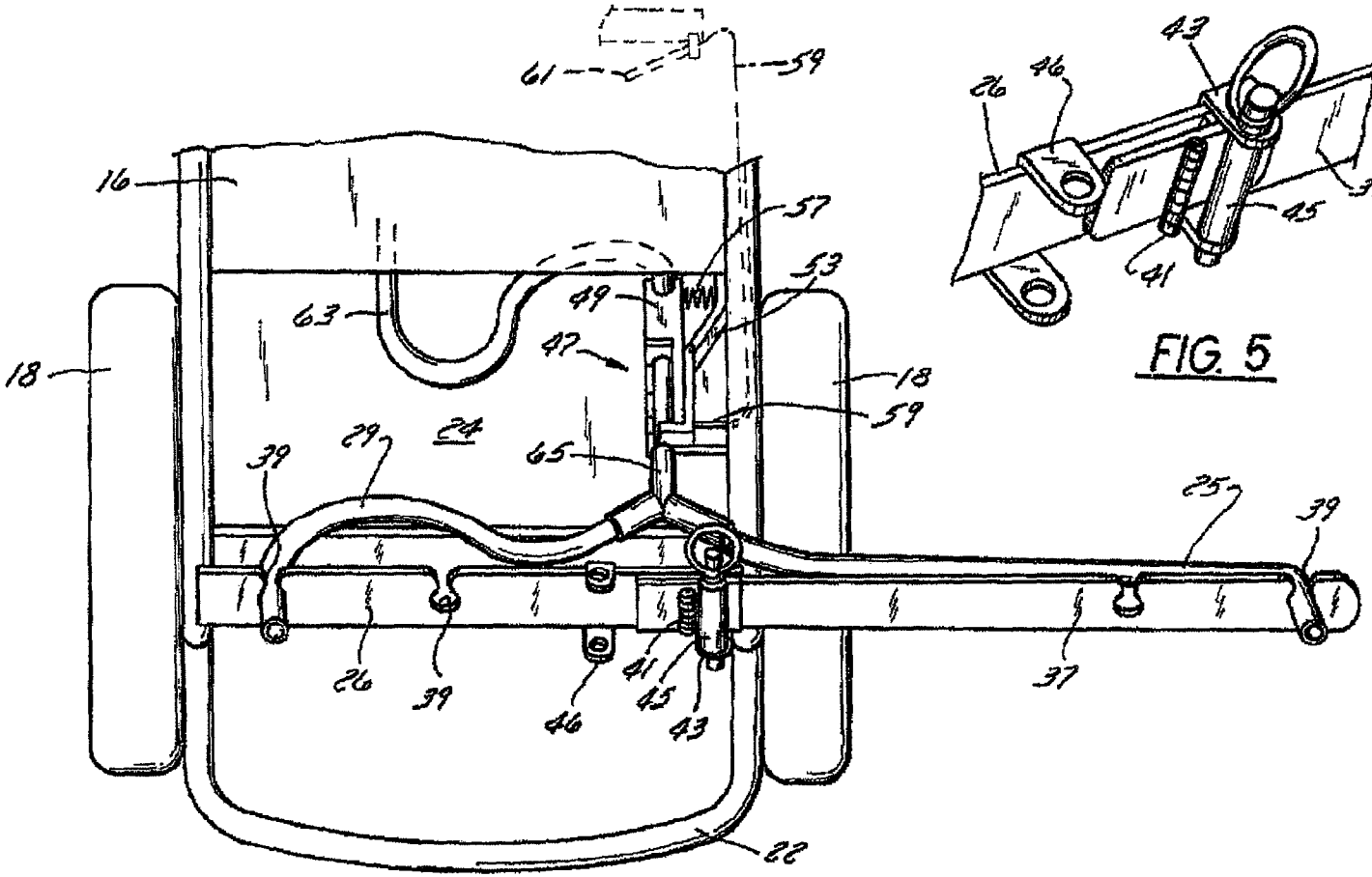
FIG. 5 is a detailed view showing the connection of the pivotal connecting spreader bar member.
FIG. 6 is a front partial view showing the spreader bar member supporting the floor finish conveying conduits.
Figure 7:
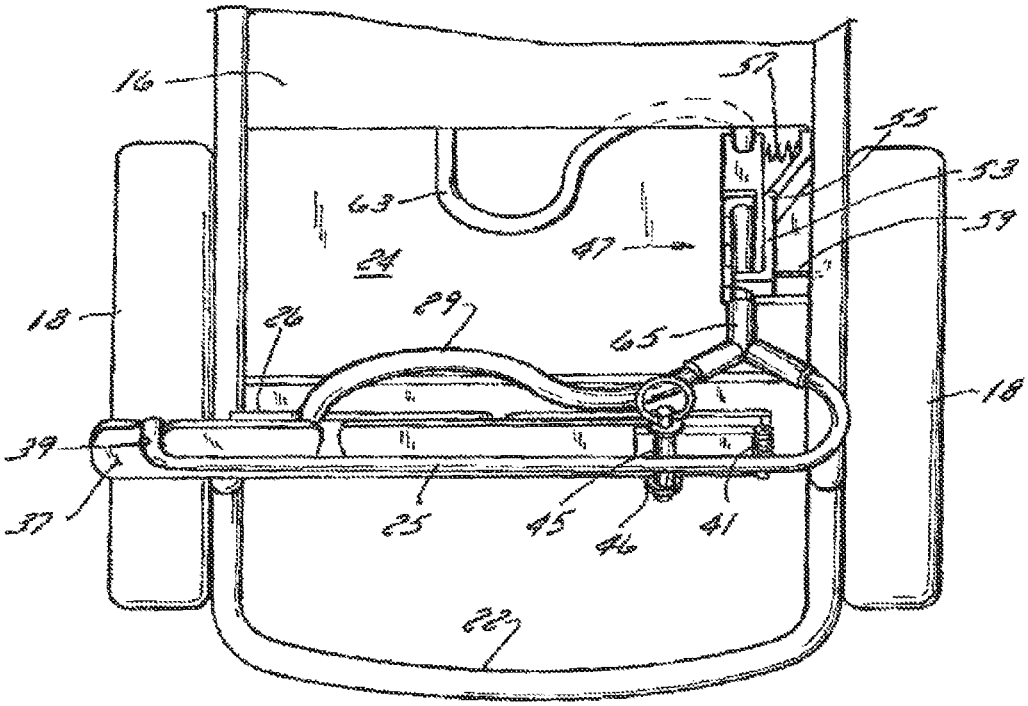
FIG. 7 is a view similar to FIG. 6 illustrating the spreader bar members in a folded condition.

Referring to FIGS. 5-7, spreader bar member 37 is pivotally connected to spreader bar member 26 by means of hinge 41. It is held in a hinged open position by bracket 43 and the pin 45. A second bracket 46 is connected to spreader bar member 26. This serves to clamp pivotal spreader bar 37 in a folded position as seen in FIG. 7 when pin 45 is placed in bracket 46. Spreader bar members 26 and 37 have notches 39 for supporting conduits 25 and 29 therein.

Figure 8:
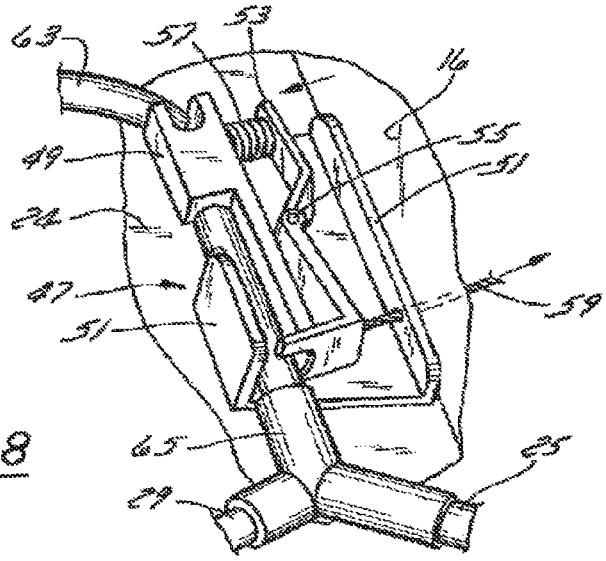
FIG. 8 is a detailed view of the valve for controlling the flow of floor finish through the floor finish conveying conduits.

The flow of floor finish from bag 23 to conduits 25 and 29 is controlled by the control pinch clamp generally 47 connected to sloping panel 24. This is best seen in FIG. 8. Feed tube 63 is connected to bag 23 and extends through pinch clamp 47 which includes body member 49 and clamp plate 51. Clamp member 53 is biased closed by spring 57 to position clamp member 53 in engagement with feed tube 63. This is seen in FIG. 7. Clamp member 53 is opened by the cable 59 connected to hinged clamp member 53 having support hinge 55. A control lever 61 on handle member 14 pulls cable 59 to open clamp member 53. Feed tube 63 is interconnected to conduits 25 and 29 by the Y connector 65.

Figure 4:
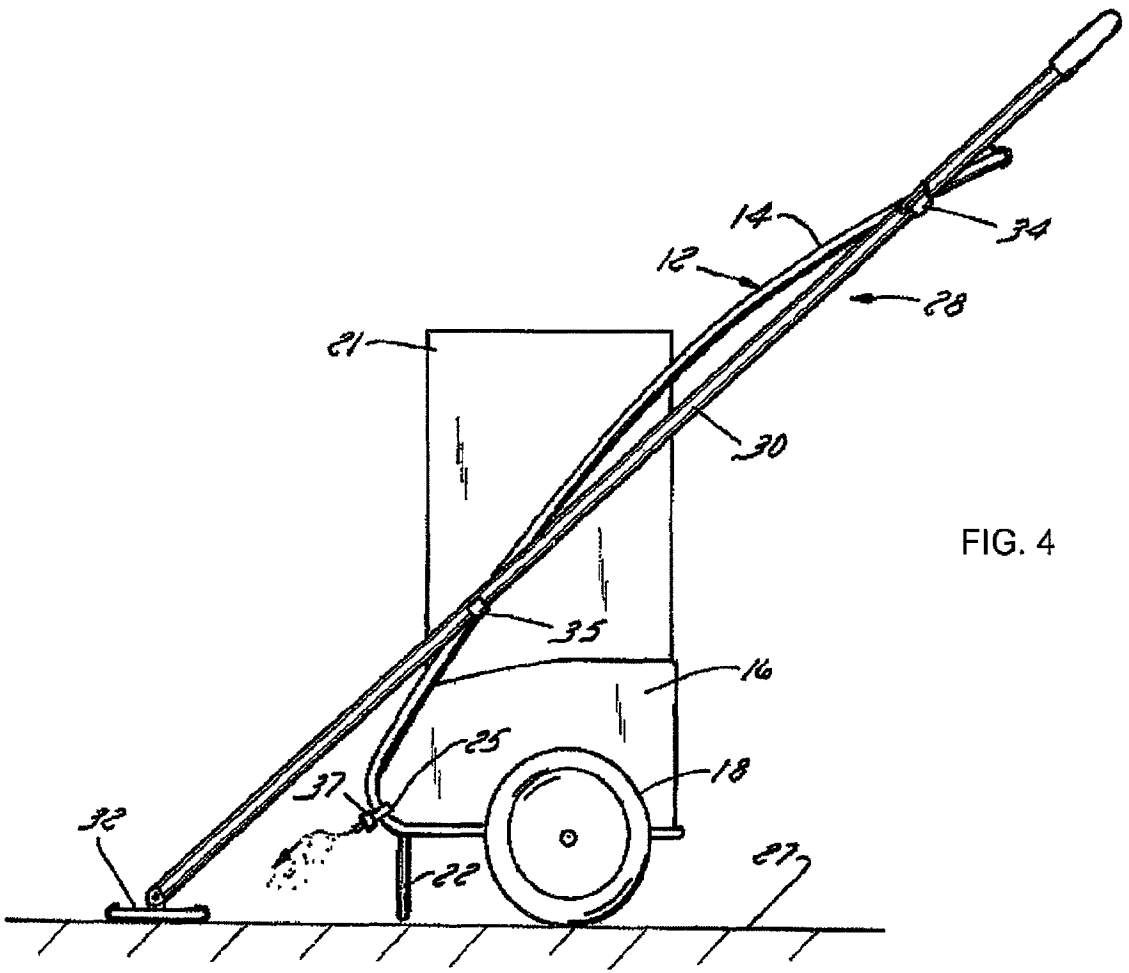
FIG. 4 is a side view of the applicator illustrated in FIG. 1 with the mop attached and illustrating the dispensing of floor finish.

A further understanding of the floor finish applicator 10 can be had by a description of its operation as seen in FIGS. 1-8. The bag 23 containing floor finish is placed in box 21 and the box loaded onto the cart 10 as illustrated in FIG. 1. Bag 23 is connected to feed tube 63 as indicated in FIG. 6 which shows control clamp 47 in the closed position and pinching off the feed tube 63. Initially, pivotal spreader bar member 37 is in a folded position as illustrated in FIG. 7. To extend bar 37, pin 45 is pulled from bracket 46 and spreader bar member 37 pivotally extended to the position shown in FIG. 6 by means of hinge 41. Pin 45 is then placed in bracket 43 to secure spreader bar 37 member to bar 26. This provides an offset position from a central axis of the cart 12 and places the open ends of 31 and 33 of conduits 29 and 25, respectively in a dispensing position. The open ends 31 and 33 have dispensing nozzles such as nozzle 36 attached thereto as seen in FIG. 4. Mop handle 30 is clamped to handle member 14 by means of clamps 34 and 35. It is positioned to extend in front of cart 12 and extended in a manner to lift skid member 22 so as to place a portion of the weight of the loaded cart 12 on the mop pad 32. This is seen in FIG. 4. This arrangement positions the cart about 5 degrees from an upright position.

Pinch valve 47 is opened by compressing lever 61 which places the pinch clamp 47 in the position seen in FIG. 8. Floor finish then flows through conduits 25 and 29 and out through nozzles such as 36. Floor finish is distributed by the mop pad 32 as the cart 12 is moved in a backward manner. In order to apply floor finish to a surface not easily accessible by the cart 12, the mop 28 is unclamped therefrom and employed in the usual manner.

It will thus be seen that there is provided a floor finish applicator composed of consumable parts. This is seen though the use of the bag 23 in the box 21 as well as plastic feed tube 63 and conduits 25 and 29. These parts are readily disposable after use. Further, floor finish applicator 10 provides a dual use of mop 28. It acts as a spreader for the floor finish when attached to the cart 12, yet allows use separately as a hand operated mop.

A particular pinch valve 47 has been described in conjunction with applicator 10. Any type of clamp could be employed which effects a compressing and stoppage of flow through flexible tubing 63. Neither is the particular design of mop 28 essential. Any mop with a disposable mop head can be substituted as long as it effects appropriate spreading and leveling of the floor finish.

The embodiment illustrated in FIGS. 1-8 related to a floor finish applicator that delivered floor finish from a reservoir to the floor via gravitational forces. In other words, the assistance of a pump was not utilized. FIGS. 9-15, however, illustrate another floor finish applicator quite similar to the one illustrate above, except a pump is utilized to deliver the floor finish to the floor. Many features of this embodiment are quite similar to features of the embodiment illustrated in FIGS. 1-8. As such, those common or similar features will generally be given similar reference numbers.

Figure 9:
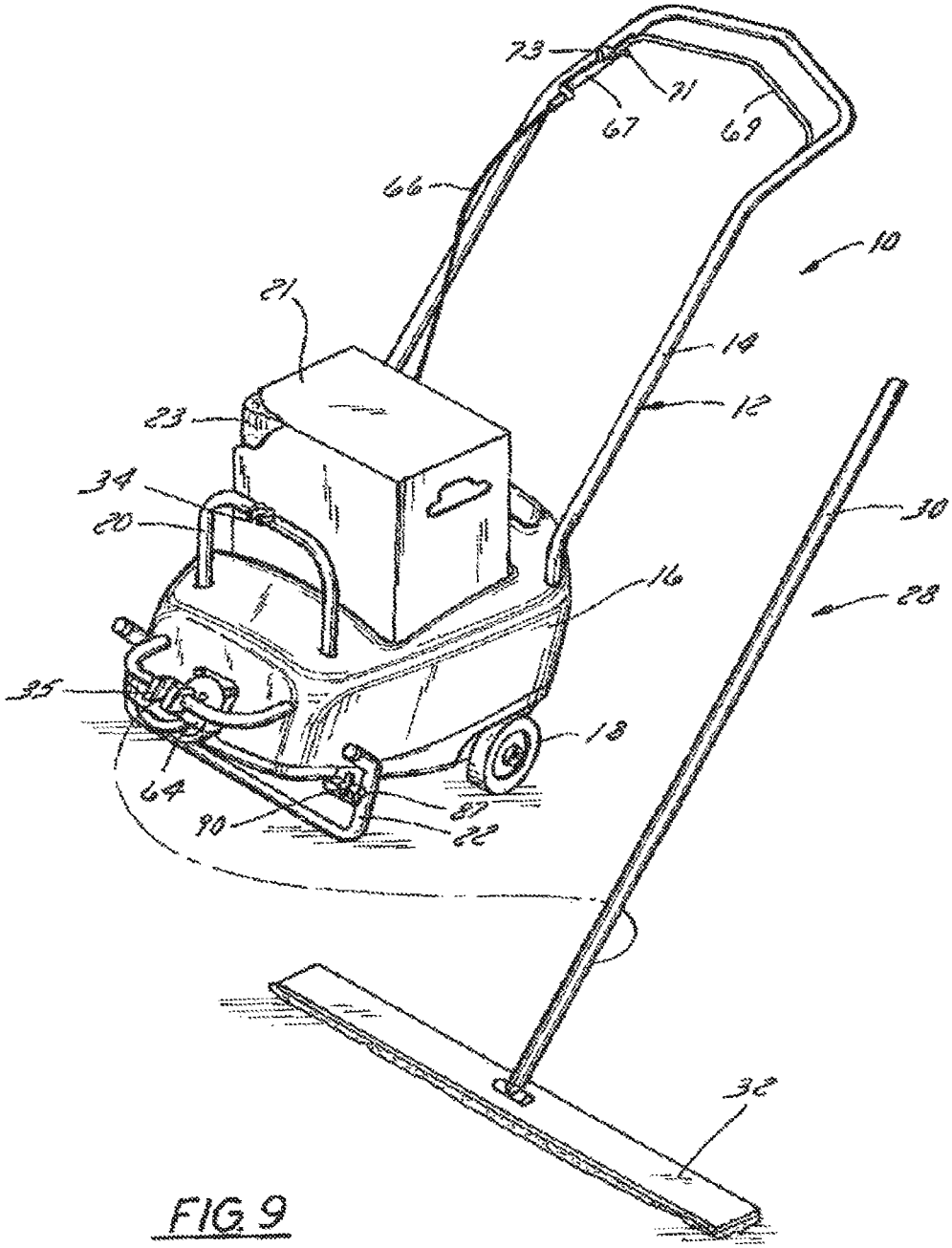
FIG. 9 is a perspective view of the floor finish applicator embodying aspects of this invention, showing a mop disconnected from the applicator.
Figures 10, 11:
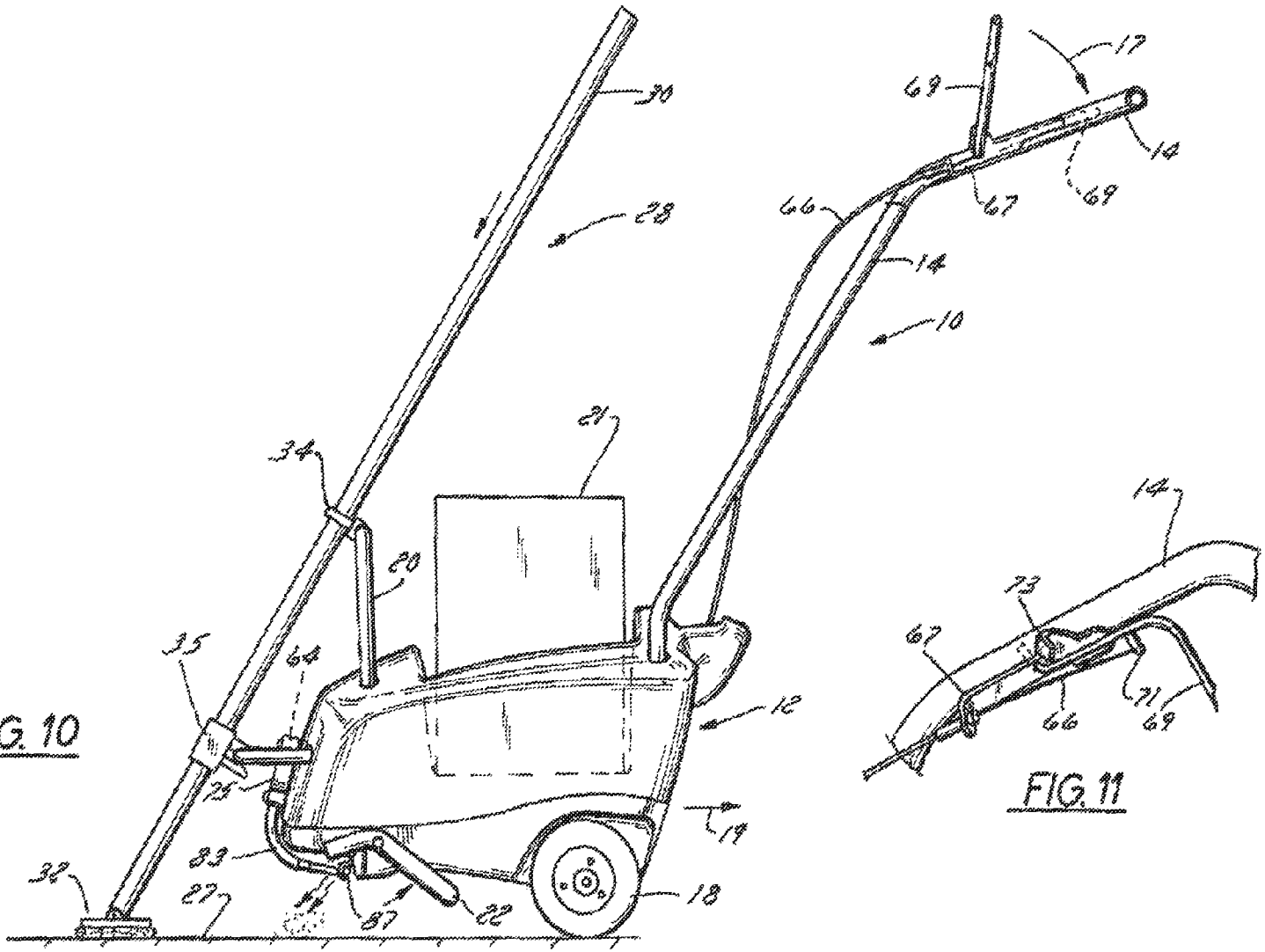
FIG. 10 is a side view of the applicator illustrated in FIG. 9 with the mop attached and illustrating the actuation of a bail.
FIG. 11 is a detailed view of the stop mechanism for the bail illustrated in FIG. 10.

As shown in FIGS. 9-10, the floor finish applicator generally 10 includes a cart 12 with a U-shaped tubular handle member 14 joined to a molded plastic base portion 16 with wheels 18 rotatably mounted thereon. A box 21 with a bag 23 containing floor finish is supported in housing 16 which provides a carrier member for the box 21. A kickstand 22 supports base portion 16 of cart 12. A spring 60 pivotally biases kickstand 22 toward the housing 16.

Connected to the housing 16 is a frame member 20 with clamps 34 and 35. A mop 28 having a handle 30 and a mop head 32 is removably attached to the frame member 20 by the clamps 34 and 35. In a preferred manner, mop head 32 has a pad comprised of materials of different sizes for purpose of spreading and leveling the floor finish. It can be made of foam, flocked foam, woven or non-woven cloth.

Figure 15:
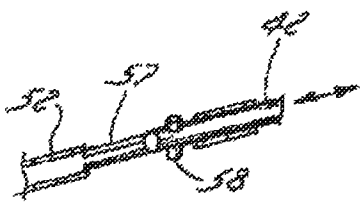
FIG. 15 is a sectional view taken along line 15-15 of FIG. 14.
Figure 14:
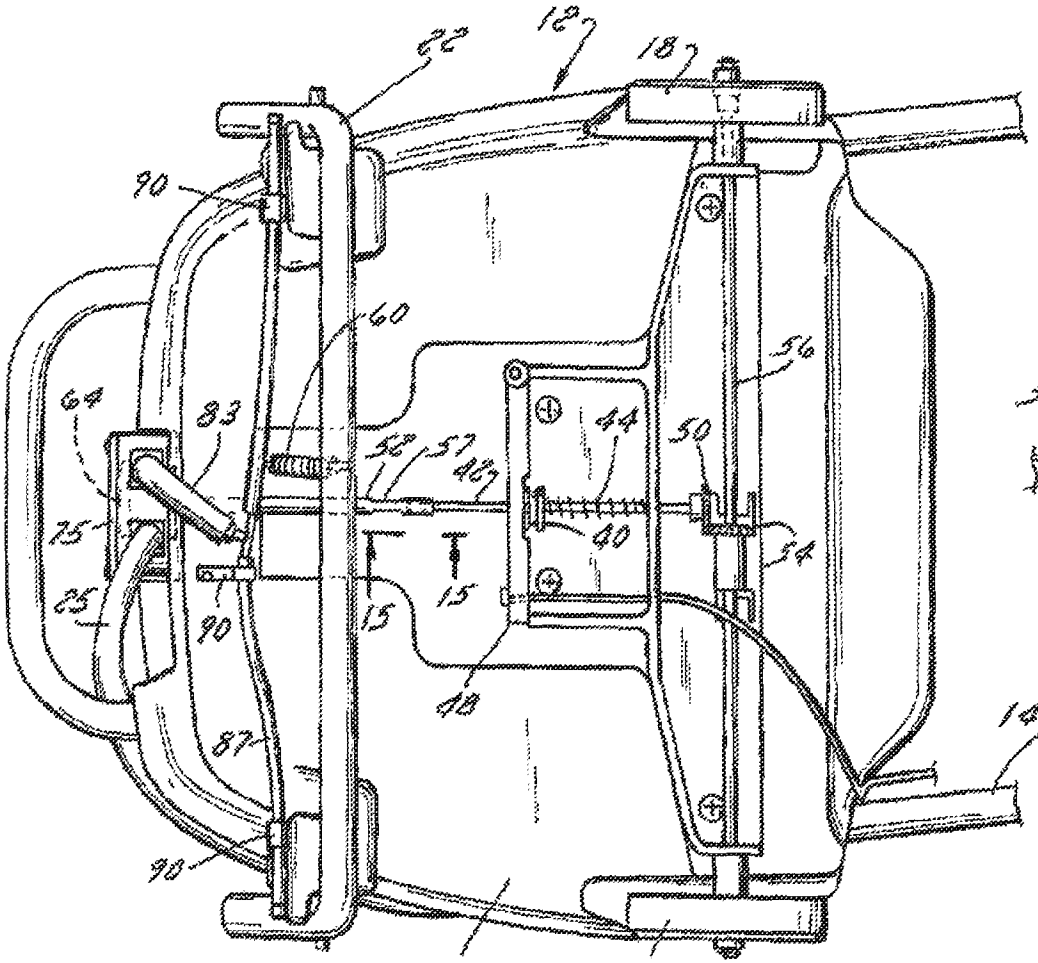
FIG. 14 is a view similar to FIG. 12 showing the drive means in an activated position.

Referring to FIGS. 11, 14 & 15 a transmission assembly for transmitting power from the wheels to the pump 64 is shown. The transmission assembly includes a spring loaded clutch 38 for selectively controlling actuation of the pump 64. The clutch includes a thrust washer 40 slideably received on drive shaft 42. A spring 44 biases washer 40 against pivotal bar 48. Cable 66 is attached to pivotal bar 48. A bevel gear 50 is connected to drive shaft 42. The opposing end of drive shaft 42 is slideably received in drive shaft 52 which connects to pump 64. A drive gear 54 is mounted on axle 56.

Figure 13:
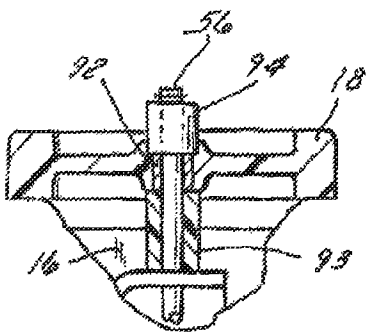
FIG. 13 is a detailed view of FIG. 12 in cross-section showing a roller clutch in conjunction with a wheel.
Figure 12:
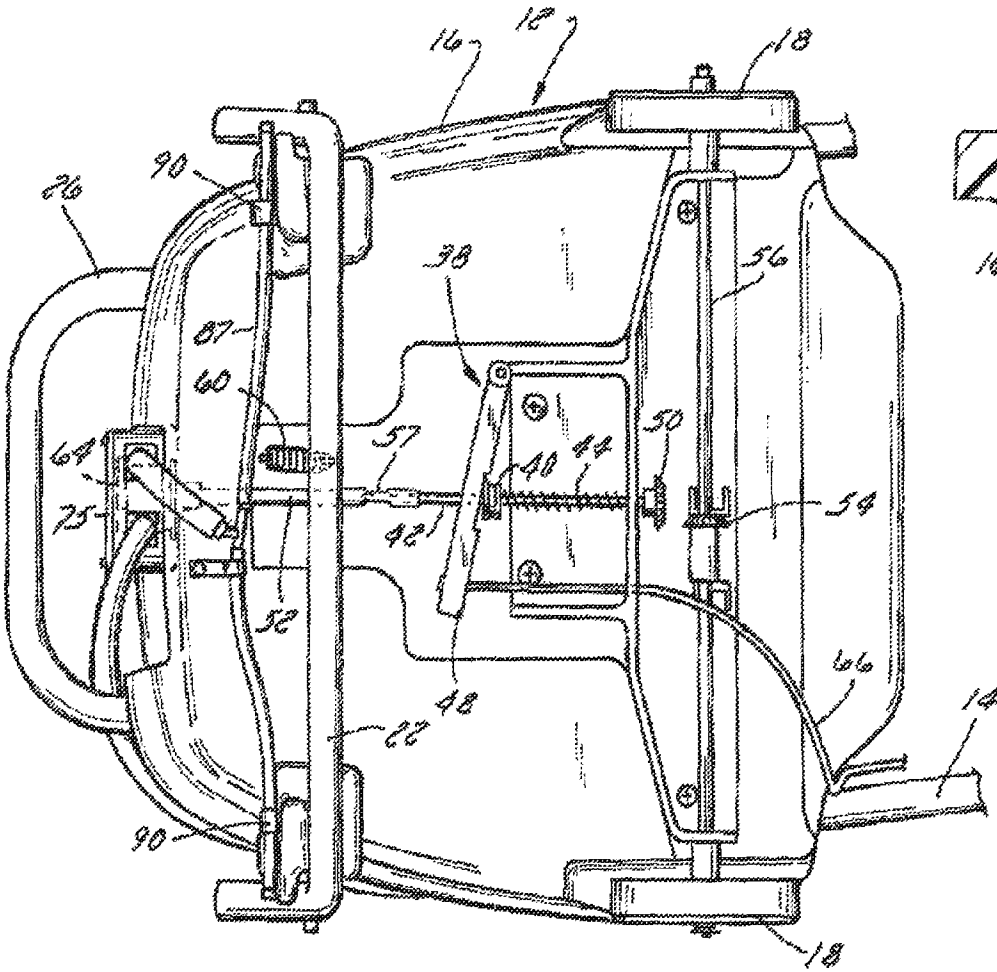
FIG. 12 is a bottom view of the applicator shown in FIG. 9 illustrating the drive means for activating a pump, the drive means in a deactivated position.

As seen in FIGS. 10 and 13, cable 66 is also attached to bail 69 by the connecting peg 71 and is slideably secured in bracket 67 dispensed on handle 14. Bail 69 is pivotally attached to handle 14. There is also a bail stop 73 connected to handle 14.

The pump 64 can include a variety of different pumps, such as piston pump, gear pump, diaphragm pump, peristaltic pump, and the like. While each pump can be utilized to deliver floor finish and can be operable via the transmission assembly described above, the peristaltic pump embodiment is a highly preferred embodiment. As explained in greater detail below, the peristaltic pump is preferred because it is substantially easier to clean since the floor finish does not contact the pump.

Figure 16:
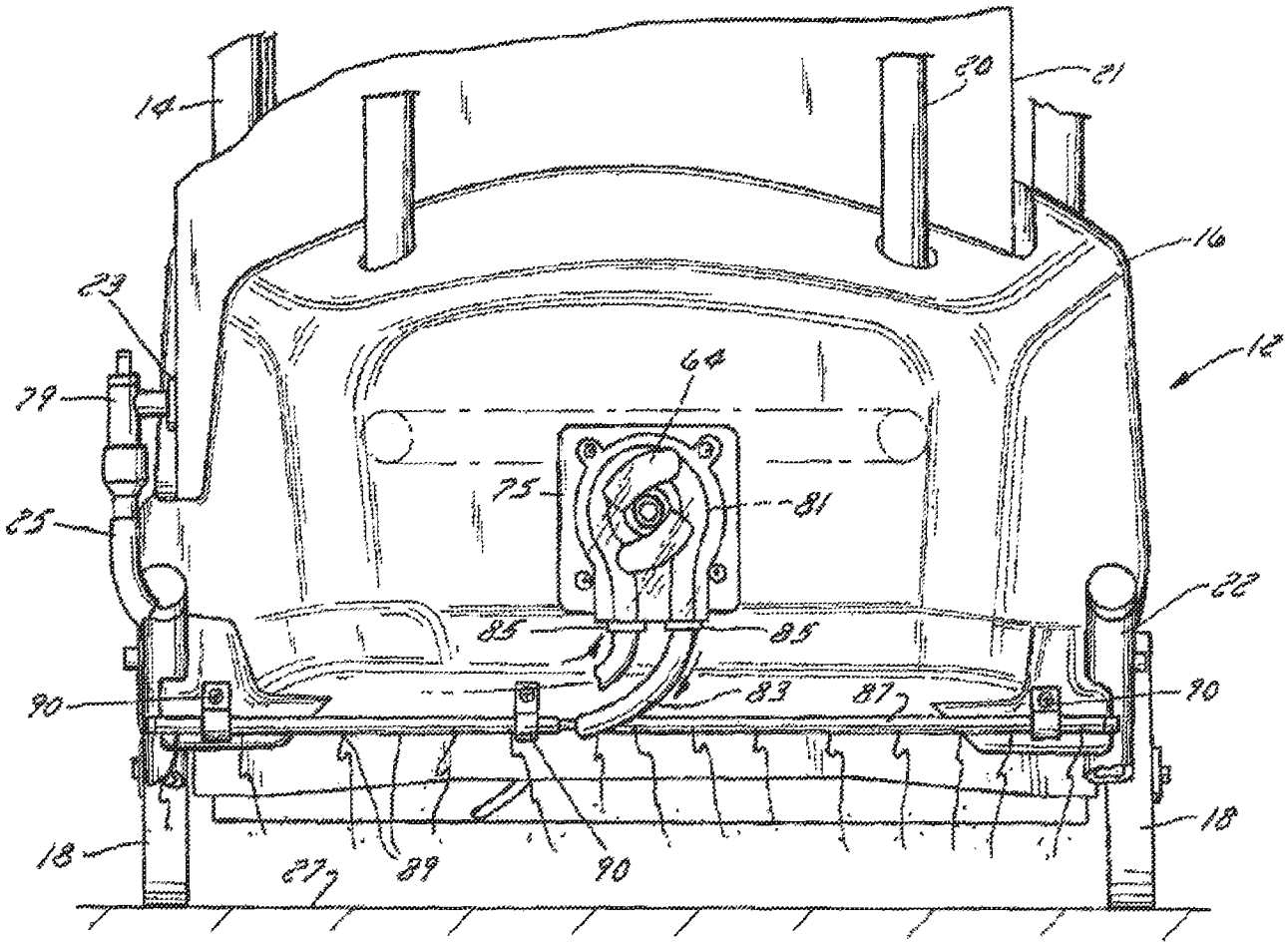
FIG. 16 is a front view of the applicator illustrated in FIG. 9 showing the pump and illustrating the dispensing of floor finish.

Referring to FIG. 16, the peristaltic pump is housed in compartment 75. A floor finish feed conduit 25 is in fluid communication with the bag 23 by means of the connector 79. Feed conduit 25 is also in fluid communications with pump conduit 81 and is output conduit 83. Sleeves 85 provide connection between conduits 25, 83 and pump conduit 81. A spray conduit 87 with orifices 89 is attached to housing 16 by the brackets 90.

A further understanding of the floor finish applicator 10 can be had by a description of its operation as seen in FIGS. 9-16. The bag 23 containing floor finish in placed in box 21 and the box loaded into the housing 16 of cart 12 as illustrated in FIG. 9. Bag 23 is connected to flexible feed tube 25 as indicated in FIG. 16. Mop 28 is clamped to the applicator 10 by means of clamps 28 and 29, as shown in FIG. 10. When it is desired to dispense floor finish from bag 23 onto the floor surface 27, the applicator 10 is moved in a direction indicated by the directional arrow 19 shown in FIG. 10. Bail 69 is then moved in the direction shown by the directional arrow 17, this causes pivotal bar 48 to move from the position shown in FIG. 12 to that shown in FIG. 14 whereby drive shaft 42 is moved by thrust washer 40 to move bevel gear 50 in engagement with drive gear 54 which is rotated by the rotation of axle 56 by wheels 18. Rotation of drive shaft 42 rotates drive shaft 52 through the pin 58 and slot 57 arrangement shown in FIG. 15. This affords linear movement of shaft 42 in shaft 52 while maintaining connection of the two shafts. Rotation of shaft 52 effects a pumping action in pump 64.

As best seen in FIG. 16, floor finish flows through flexible feed conduit 25 into peristaltic pump 64. It is pumped into output flexible conduit 83 and into spray conduit 87 where it is dispensed through orifices 89. Activation of the peristaltic pump 64 during movement of the cart 12 can be prevented by the roller clutch 94 in conjunction with wheels 18. This is shown in FIG. 13. A roller bearing 92 is mounted on shaft 56 as is roller clutch 94. A spacer 93 separates bearing 92 and housing 16. In the event bail 69 is not moved to a position to place pivot bar 48 in the position shown in FIG. 12 with the non-engagement of gears 50 and 54, roller clutch prevents activation of pump 64 during movement of the cart 12.

An advantageous feature of some embodiments of the applicator is the disposable connector 79 and the disposable flexible conduits 25, 81, 83 and spray conduit 87. When the application of the floor finish in complete, these components can be readily removed and replaced without any cleaning of the peristaltic pump 64. In other words, through the use of a peristaltic pump, the floor finish never contacts the pump. As such, time consuming clean-up is not necessary. Rather, the conduit is simply removed from the pump and replaced prior to next operation.

Another advantage of some embodiments the application 10 is the dual use of mop 28. It acts as a spreader for the floor finish when attached to the cart 12, yet allows use separately as a hand operated mop in order to apply floor finish to areas of floors not readily accessible when attached to the applicator.

A roller clutch 94 has been described in conjunction with applicator 10. If desired this could be eliminated as deactivation of the pump 64 can be effected during a forward motion of the applicator by placing bail 69 in the upward position shown in solid lines in FIG. 10. Neither is it essential to have the mop 28 disengageable from the applicator 10. Furthermore, although the embodiment illustrated above harnessed the power of the wheels to drive the pump, other embodiments can utilize an electric pump with the detachable handle. All such and other modifications within the sprit of the invention are meant to be within the scope as defined by the appended claims.

The invention claimed is:

1. A floor finish applicator comprising:

a cart having wheels and a body member constructed and arranged to receive a source of floor finish;

a pump coupled to the cart and operable to deliver floor finish to a floor;

a floor finish feed conduit in fluid communication between the pump and a container adapted to hold floor finish, the floor finish feed conduit configured to supply floor finish to the pump; and a transmission assembly coupled to the cart and including an axle coupled to and driven by a wheel of the cart, a drive gear connected to the axle, a drive shaft having a driven gear for engaging the drive gear and driving the pump, and a hand-actuated spring-loaded clutch for selective engagement of the pump and the drive shaft with the axle.

2. The floor finish applicator of claim 1, wherein the drive gear includes a one-way roller clutch.

3. The floor finish applicator of claim 1, wherein the driven gear is a bevel gear.

4. The floor finish applicator of claim 1, wherein the spring loaded clutch actuator includes at least one thrust washer and a pivotal bar member for engaging the thrust washer.

5. The floor finish applicator of claim 1, wherein the drive shaft includes a first shaft with the driven gear and a second shaft, the first and second shafts interconnected by a pin and slot arrangement.

6. The floor finish applicator of claim 1, further comprising a user-operable bail coupled to the clutch.

7. The floor finish applicator of claim 6, wherein the bail is located on a user-operable handle of the cart located remotely from the clutch.

8. The floor finish applicator of claim 1, further comprising a user-actuatable cable coupled to and extending from the clutch to a location remote from the clutch.

9. A floor finish applicator comprising:

a cart including a body member adapted to support a reservoir of floor finish;

a handle coupled to the body;

a pair of wheels coupled to the body member and at least partially defining a pivot point of the body when force is applied to the handle;

a pump coupled to the cart and operable to deliver floor finish to a floor;

a floor finish feed conduit in fluid communication between the pump and a container adapted to hold floor finish, the floor finish feed conduit configured to supply floor finish to the pump; and a transmission assembly coupled to the cart and including a first shaft rotatably coupled to the pump to drive the pump via rotation of the first shaft, a second shaft coupled to and driven by at least one of the wheels, and a hand-actuated clutch drivably coupling the first shaft and the second shaft to each other, the hand-actuated clutch having a first state in which the second shaft is drivably engaged with the first shaft to transfer rotational motion of the second shaft to rotational motion of the first shaft, and a second state in which the second shaft is disengaged from the first shaft to permit rotation of the second shaft independently of the shaft, the hand-actuated clutch biased into the second state.

10. The floor finish applicator of claim 9, further comprising a user-operable bail coupled to the clutch.

11. The floor finish applicator of claim 10, further comprising a cable coupling the user-operable bail and the clutch.

12. The floor finish applicator of claim 10, wherein the bail is located on a user-operable handle of the cart located remotely from the clutch.

13. The floor finish applicator of claim 9, wherein the first shaft and the second shaft are drivably coupled to each other in the first state via intermeshing gears.

14. The floor finish applicator of claim 13, wherein the first shaft and the second shaft are drivably coupled to each other by a first gear coupled to the first shaft that in a second gear coupled to the second shaft, and wherein the first gear is releasably engaged with the second gear.

15. The floor finish applicator of claim 9, further comprising a user-actuatable cable coupled to and extending from the clutch to a location remote from the clutch.

16. The floor finish applicator of claim 9, further comprising a spring attached to the first shaft and biasing the clutch into the second state.

17. The floor finish applicator of claim 16, further comprising a user-actuatable cable coupled to and extending from the clutch to a location remote from the clutch, wherein actuation of the cable generates a force counter to the biasing force of the spring.

18. The floor finish applicator of claim 9, wherein the first shaft is slidably mounted for releasable engagement of the first shaft and the second shaft.

19. The floor finish applicator of claim 18, wherein the first shaft and the second shaft are drivably coupled in the first state of the clutch via at least one gear.

20. The floor finish applicator of claim 9, wherein rotation of the at least one wheel generates rotation of the first shaft in the first state, and wherein rotation of the wheel does not generate rotation of the first shaft in the second state.

* * * * *